US008177446B2

(12) United States Patent
Kuo et al.

(10) Patent No.: US 8,177,446 B2
(45) Date of Patent: May 15, 2012

(54) CARBON RIBBON RETAINING MECHANISM

(75) Inventors: Shang-Shih Kuo, Yonghe (TW); Chin-Chuan Liu, Taipei (TW)

(73) Assignee: TSC Auto ID Technology Co., Ltd., I-Lan Hsien (TW)

( * ) Notice: Subject to any disclaimer, the term of this patent is extended or adjusted under 35 U.S.C. 154(b) by 481 days.

(21) Appl. No.: 12/453,287

(22) Filed: May 6, 2009

(65) Prior Publication Data

US 2009/0279932 A1 Nov. 12, 2009

(30) Foreign Application Priority Data

May 9, 2008 (TW) ..... 97208054 U

(51) Int. Cl.
*B41J 29/02* (2006.01)

(52) U.S. Cl. ..... 400/693.1

(58) Field of Classification Search ..... 400/191–250, 400/691–693.1, 694
See application file for complete search history.

(56) References Cited

U.S. PATENT DOCUMENTS 5,672,020 A * 9/1997 Leonard et al. ..... 400/690.4
6,022,158 A * 2/2000 Nakayama et al. ..... 400/613
6,491,459 B2 * 12/2002 Hosomi ..... 400/613
6,494,631 B1 * 12/2002 Mastinick ..... 400/208
6,997,628 B2 * 2/2006 Tu ..... 400/208
7,651,287 B2 * 1/2010 Numata et al. ..... 400/120.01

* cited by examiner

*Primary Examiner* — Seung Lee
*Assistant Examiner* — Christle Marshall
(74) *Attorney, Agent, or Firm* — Rosenberg, Klein & Lee

(57) ABSTRACT

A carbon ribbon retaining mechanism includes a barcode-printer base, an upper cover, a printing head device, and at least one pair of resilient fastener elements. The barcode-printer base has an upper portion forming a receiving space. The upper cover is coupled to the receiving space of the barcode-printer base for being downward closed to and covering the receiving space. At least one pawl is respectively formed on opposite edge portions of the upper cover. The printing head device is accommodated in the receiving space. A carbon ribbon retention shaft is arranged above the printing head device. The resilient fastener elements are mounted above the printing head device. By means of the engagement effected between the pawls of the upper cover and the resilient fastener elements, the upper cover is fixed to and above the printing head device to cover the receiving space. Further, by flapping the upper cover upward, the pawls of the upper cover are disengaged from the resilient fastener elements to allow opening of the upper cover and thus expose the carbon ribbon retention shaft for replacement and/or maintenance.

6 Claims, 5 Drawing Sheets

CARBON RIBBON RETAINING MECHANISM

BACKGROUND OF THE INVENTION

1. Field of the Invention

The present invention relates to a carbon ribbon retaining mechanism, and in particular to a carbon ribbon retaining mechanism that is applicable to a barcode printer and features an upper cover that is fastened in a resilient manner to facilitate opening/closing for replacement and maintenance of a carbon ribbon retention shaft and a carbon ribbon.

2. The Related Arts

A conventional barcode printer includes a printing mechanism functioning to effect printing operation on a barcode label received inside the barcode printer. In the printing process, a toner that is required for the printing operation carried out by a printing head is supplied by a carbon ribbon in order to have desired barcodes and digits printed on the barcode labels. However, the conventional printing mechanism of the barcode printer has to collect the used carbon ribbon and thus, a carbon ribbon retention shaft must be provided inside the barcode printer. The carbon ribbon retention shaft of the printing mechanism of the conventional barcode printer is fixed in the interior of the barcode printer, so that a great amount of labor and effort has to be spent in dismounting an enclosure and interior components of the barcode printer before replacement and/or maintenance of a carbon ribbon and/or the carbon ribbon retention shaft can be carried out. Thus, the replacement and/or maintenance of the carbon ribbon and/or the carbon ribbon retention shaft are difficult and troublesome and consume a great amount of human labor and working hours. This is not economically efficient.

SUMMARY OF THE INVENTION

Due to the fact that the conventional printing mechanism of the barcode printer comprises a carbon ribbon retention shaft securely fixed in the interior of the barcode printer, a great amount of labor and working hours has to be spent in dismounting an enclosure and interior components of the barcode printer before replacement and/or maintenance of a carbon ribbon and/or the carbon ribbon retention shaft can be carried out, so that problems and drawbacks that replacement and/or maintenance of the carbon ribbon and/or the carbon ribbon retention shaft are difficult and troublesome occur.

Thus, the present invention is aimed to provide a carbon ribbon retaining mechanism, comprising a barcode-printer base, an upper cover, a printing head device, and at least one pair of resilient fastener elements. The barcode-printer base has an upper portion forming a receiving space. The upper cover is coupled to the receiving space of the barcode-printer base for being downward closed to and covering the receiving space. At least one pawl is respectively formed on opposite edge portions of the upper cover. The printing head device is accommodated in the receiving space. A carbon ribbon retention shaft is arranged above the printing head device. The resilient fastener elements are mounted above the printing head device. By means of the engagement effected between the pawls of the upper cover and the resilient fastener elements, the upper cover is fixed to and above the printing head device to cover the receiving space. Further, by flapping the upper cover upward, the pawls of the upper cover are disengaged from the resilient fastener elements to allow opening of the upper cover and thus expose the carbon ribbon retention shaft for replacement and/or maintenance.

The effectiveness of the carbon ribbon retaining mechanism of the present invention is that the upper cover and the resilient fastener elements are employed to allow efficient and low-cost replacement and/or maintenance of a carbon ribbon and/or a carbon ribbon retention shaft that are located above a printing head to be carried out without spending a great amount of effort to dismounting an enclosure and internal components of a barcode and thus enhance the industrial value of the present invention.

BRIEF DESCRIPTION OF THE DRAWINGS

The present invention will be apparent to those skilled in the art by reading the following description of a preferred embodiment thereof, with reference to the attached drawings, wherein.

DETAILED DESCRIPTION OF THE PREFERRED EMBODIMENT

Figure 1:
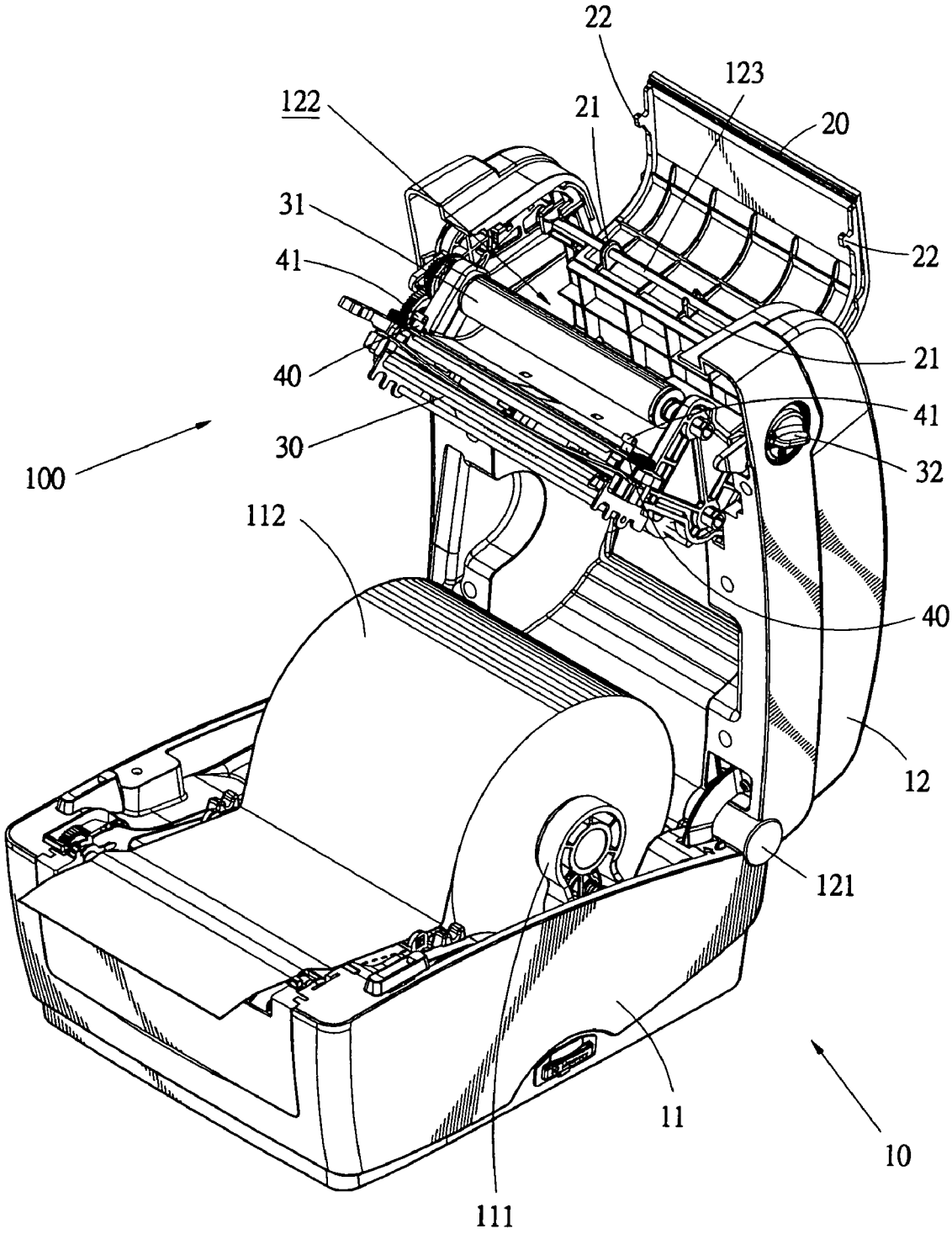
FIG. 1 is a perspective view showing a carbon ribbon retaining mechanism constructed in accordance with the present invention.
Figure 2:
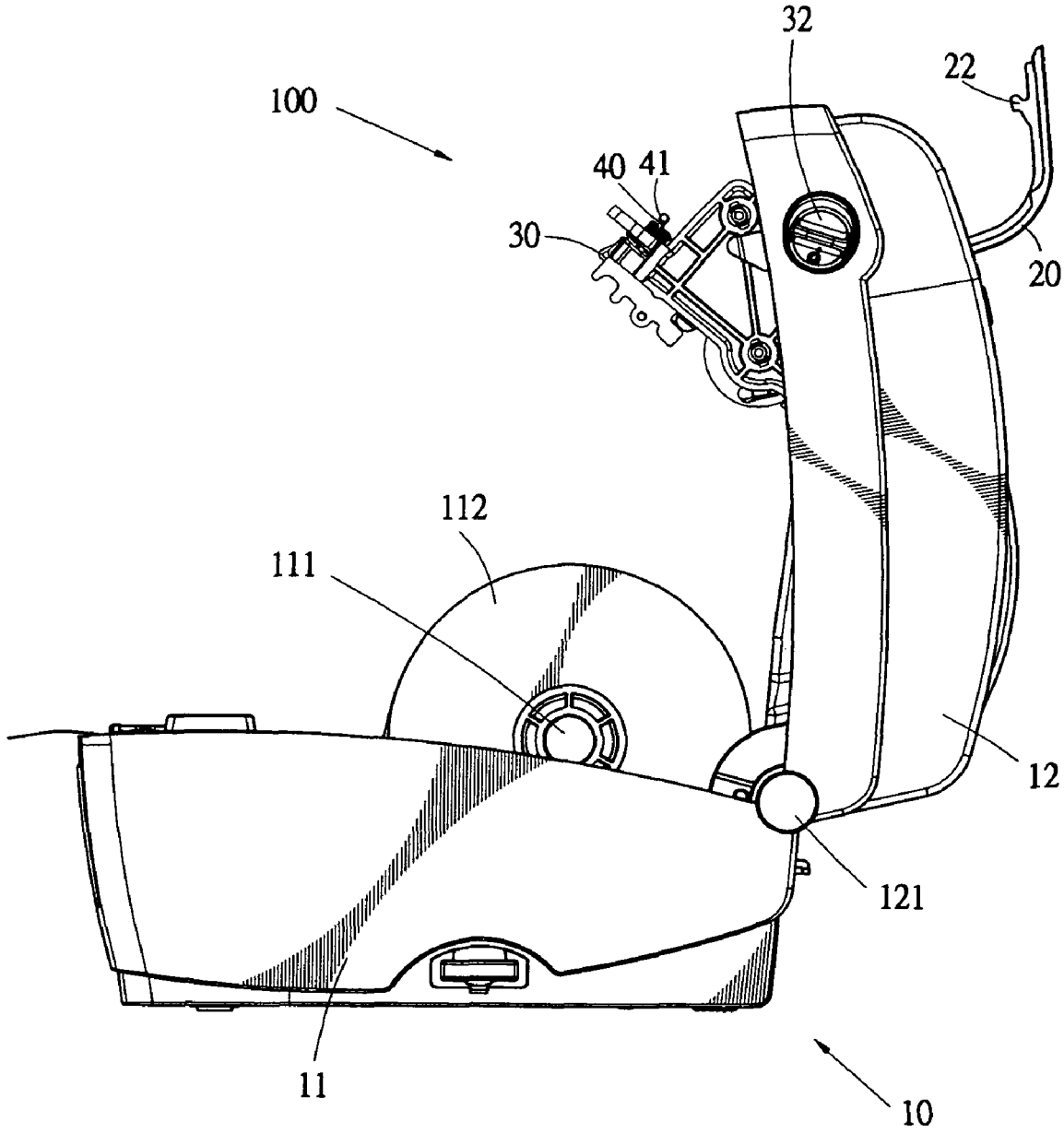
FIG. 2 is a side elevational view of FIG. 1, showing an upper cover is flapped upward for opening.

With reference to the drawings and in particular to FIGS. 1 and 2, a carbon ribbon retaining mechanism constructed in accordance with the present invention, generally designated at 100, comprises a barcode-printer base 10, which is comprised of a base portion 11 and a printer portion 12. The base portion 11 contains therein a pair of label roll axles 111 for accommodating and retaining a barcode label roll 112 therebetween. The printer portion 12 is rotatably coupled to the base portion 11 by means of a pivot pin 121 and is located above the base portion 11. The printer portion 12 forms in an upper portion thereof a receiving space 122 across which a shaft 123 extends.

An upper cover 20 forms therein at least one pair of lugs 21, which are coupled to the shaft 123, so as to allow the upper cover 20 to be downward closed to and thus covering the receiving space 122, or to be upward flapped to expose the receiving space 122. On each of opposite edge portions of the upper cover 20, at least one pawl 22 is provided.

A printing head device 30 is received in the receiving space 122 of the printer portion 12 that is coupled above the barcode-printer base 10 for effecting printing on a surface of the barcode label roll 112. A carbon ribbon retention shaft 31 is provided above the printing head device 30 for accommodating a carbon ribbon. The way that the printing head device 30 is coupled to the printer portion 12 is not limited to any specific form and rotatable coupling to the printer portion 12 as being effected by a rotary shaft 32 is employed in the embodiment illustrated. Other means of coupling, such as using bolts to mount inside the printer portion 12, can also be used without departing from the scope of the present invention.

At least one pair of resilient fastener elements 40 is mounted above the printing head device 30 and each resilient fastener element 40 forms on a top end thereof an engaging section 41, which is flexible in bending, so that when the upper cover 20 is set in a state of being downward closed to and covering above the receiving space 122 of the printer portion 12 of the barcode-printer base 10, the pawls 22 of the upper cover 20 resiliently and correspondingly engage the engaging section 41 to have the upper cover 20 fixed to and covering above the printing head device 30.

Figure 3:
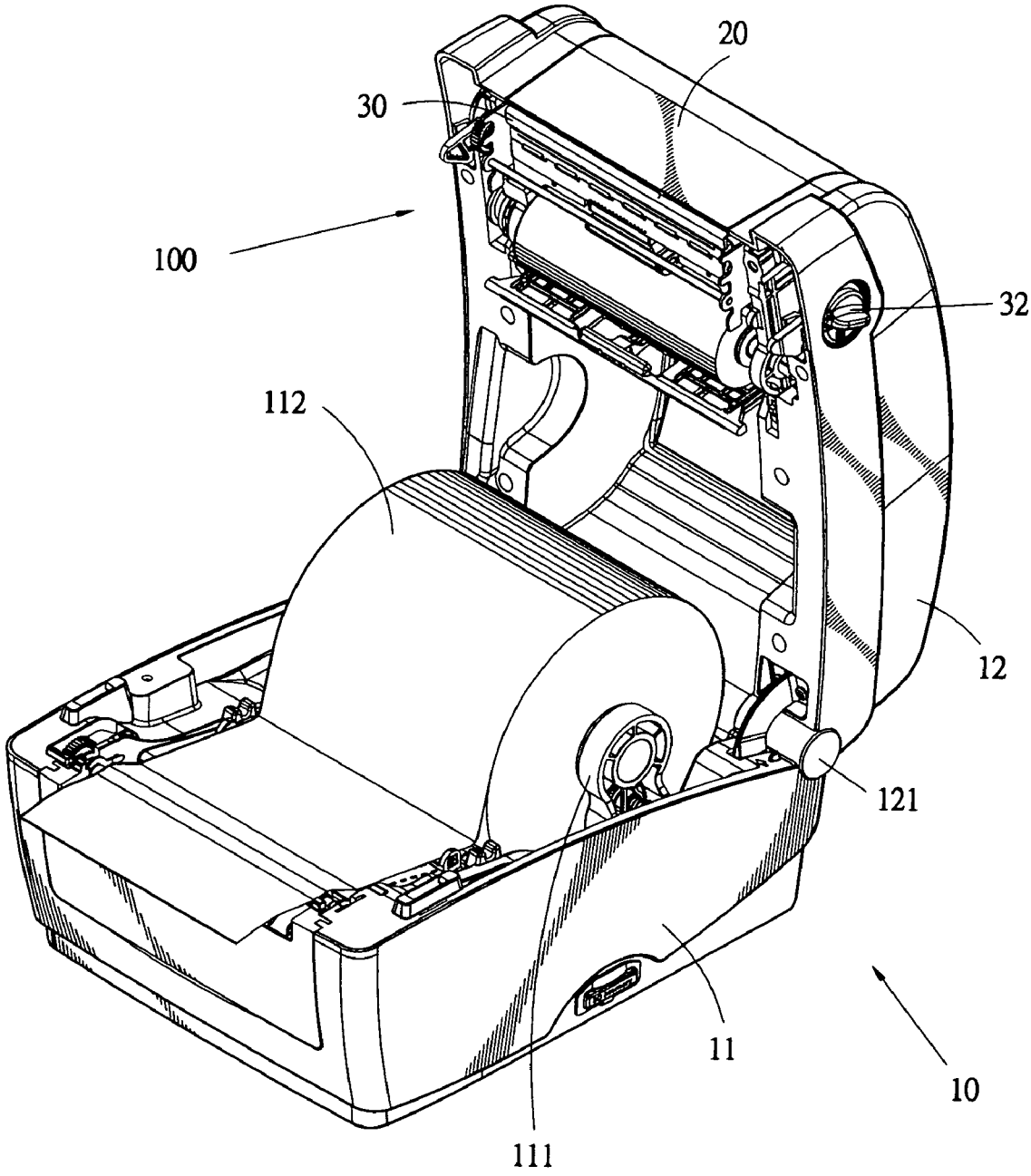
FIG. 3 is a perspective view similar to FIG. 1, but showing the upper cover is downward closed to and covering above a printer portion of a barcode-printer base.
Figure 4:
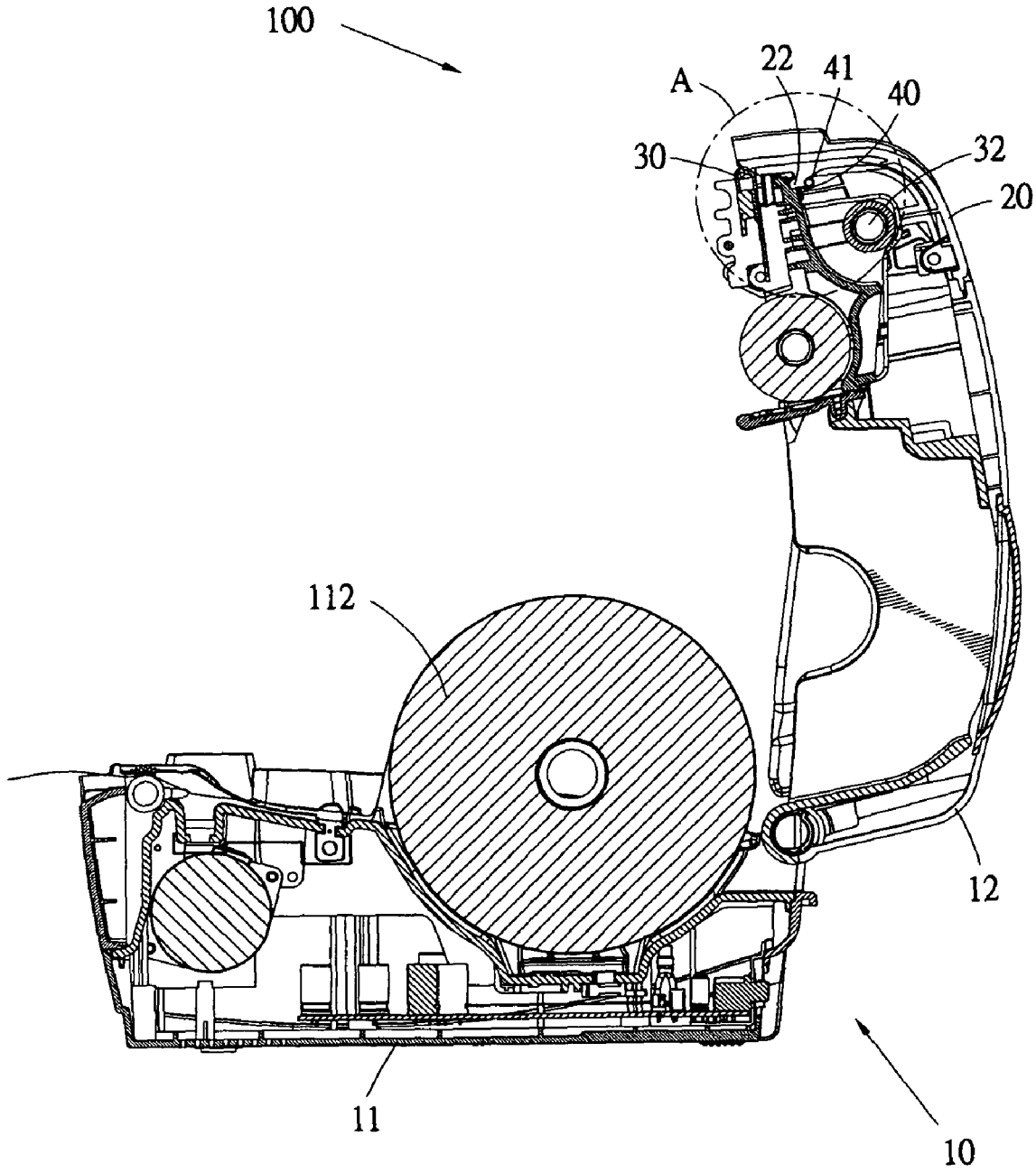
FIG. 4 is a side elevational view, in a sectioned form, of FIG. 3.
Figure 5:
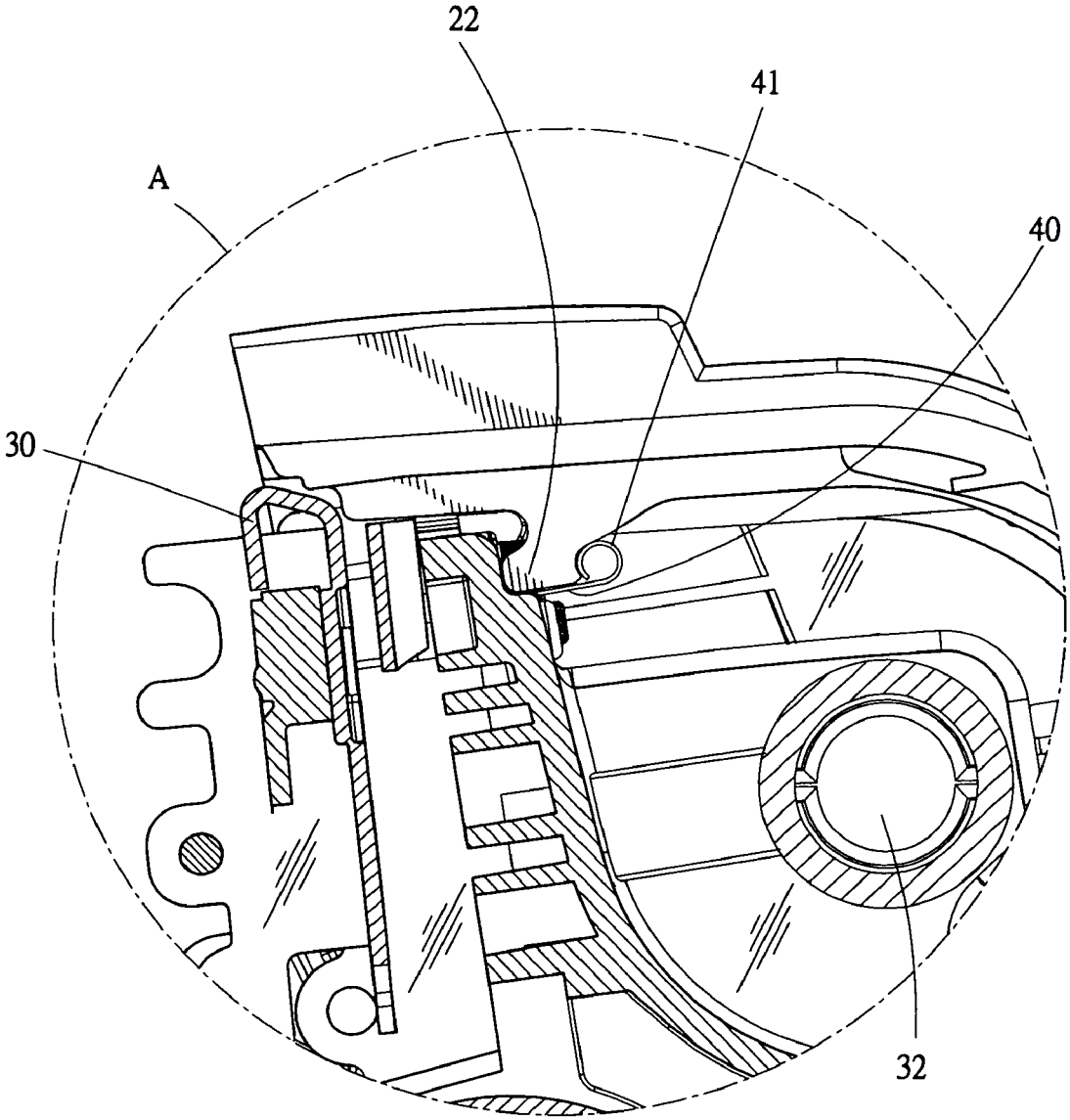
FIG. 5 is an enlarged view of a circled portion A of FIG. 4.

Also referring to FIGS. 3-5, with the upper cover 20 downward closed to and covering above the receiving space 122 of the printer portion 12 located above the barcode-printer base 10, the carbon ribbon retention shaft 31 of the printing head device 30 is fixed inside the printer portion 12, whereby when there is a need to replace or maintain the carbon ribbon retention shaft 31 or a carbon ribbon, the upper cover 20 can be opened upward to have the pawls 22 of the upper cover 20 disengaging from the engaging section 41 of the resilient fastener elements 40. Thus, the opening of the upper cover 20 immediately exposes the carbon ribbon retention shaft 31, as illustrated in the open condition shown in FIGS. 1 and 2, to facilitate replacement and maintenance of the carbon ribbon retention shaft or the carbon ribbon.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A carbon ribbon retaining mechanism, comprising:

a barcode-printer base adapted to accommodate therein a barcode label roll and having an upper portion forming a receiving space;

an upper cover coupled to the receiving space of the barcode-printer base and operable to alternately downward close to and cover the receiving space and flap upward to expose the receiving space, at least one pawl respectively formed on opposite edge portions of the upper cover;

a printing head device accommodated in the receiving space above the barcode-printer base and adapted to effect printing on a surface of the barcode label roll, a carbon ribbon retention shaft being arranged above the printing head device for accommodating a carbon ribbon; and at least one pair of resilient fastener elements mounted above the printing head device and being flexible in bending so that when the upper cover is set in a state of being downward closed to and covering above the receiving space of the barcode-printer base, the pawls of the upper cover resiliently and correspondingly engage the resilient fastener elements to have the upper cover fixed to and covering above the printing head device.

2. The carbon ribbon retaining mechanism as claimed in claim 1, wherein the barcode-printer base comprises:

a base portion containing therein a pair of label roll axles for accommodating and retaining the barcode label roll; and a printer portion rotatably coupled to the base portion and forming in an upper portion thereof the receiving space.

3. The carbon ribbon retaining mechanism as claimed in claim 2, wherein the printer portion is rotatably coupled to the base portion by means of a pivot pin.

4. The carbon ribbon retaining mechanism as claimed in claim 1, wherein the receiving space of the barcode-printer base contains therein a shaft disposed between opposite side walls.

5. The carbon ribbon retaining mechanism as claimed in claim 1, wherein the upper cover forms therein a pair of lugs.

6. The carbon ribbon retaining mechanism as claimed in claim 1, wherein the resilient fastener element forms on a top end thereof an engaging section.

* * * * *